US012389938B2

(12) United States Patent
Papakyrillou

(10) Patent No.: US 12,389,938 B2
(45) Date of Patent: Aug. 19, 2025

(54) AEROSOL-GENERATING ARTICLE HAVING A TUBULAR SUPPORT ELEMENT

(71) Applicant: Philip Morris Products S.A., Neuchatel (CH)

(72) Inventor: Stefanos Papakyrillou, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 568 days.

(21) Appl. No.: 17/600,694

(22) PCT Filed: Mar. 19, 2020

(86) PCT No.: PCT/EP2020/057660
§ 371 (c)(1),
(2) Date: Oct. 1, 2021

(87) PCT Pub. No.: WO2020/200820
PCT Pub. Date: Oct. 8, 2020

(65) Prior Publication Data

US 2022/0175022 A1 Jun. 9, 2022

(30) Foreign Application Priority Data

Apr. 4, 2019 (EP) ..... 19167434

(51) Int. Cl.
*A24D 1/20* (2020.01)
*A24D 1/04* (2006.01)
(Continued)

(52) U.S. Cl.
CPC ..... *A24D 1/20* (2020.01); *A24D 1/04* (2013.01); *A24D 3/17* (2020.01); *A24F 40/20* (2020.01); *A24F 40/46* (2020.01)

(58) Field of Classification Search
CPC ..... A24D 1/20; A24D 1/04
See application file for complete search history.

(56) References Cited

U.S. PATENT DOCUMENTS 4,776,354 A 10/1988 Norman et al.
5,027,836 A 7/1991 Shannon et al.
(Continued)

FOREIGN PATENT DOCUMENTS

CN 203723430 U 7/2014
CN 104470837 A 3/2015
(Continued)

OTHER PUBLICATIONS

Translation of CN107536115A as cited in IDS dated Oct. 1, 2021. (Year: 2018).*

(Continued)

*Primary Examiner* — Philip Y Louie
*Assistant Examiner* — Nicole A Szumigalski
(74) *Attorney, Agent, or Firm* — Oblon, McClelland, Maier & Neustadt, L.L.P.

(57) ABSTRACT

An aerosol-generating article defining a longitudinal direction extending between an upstream end and a downstream end is provided, including: a plug of aerosol-forming substrate at the upstream end; a hollow tubular support element positioned immediately downstream of the plug; and a filter segment at the downstream end of the article and positioned immediately downstream of the element, the article having a length extending in the longitudinal direction, the plug having a length extending in the longitudinal direction, the element having a length extending in the longitudinal direction between a first end of the element and a second end of the element, a ratio of the length of the element to the length of the article is between 0.3 to 1 and 0.5 to 1, and a ratio of the length of the plug to the length of the element is between 0.5 to 1 and 0.8 to 1.

18 Claims, 3 Drawing Sheets

(51) Int. Cl.

| | |
|---|---|
| ***A24D 3/17*** | (2020.01) |
| ***A24F 40/20*** | (2020.01) |
| ***A24F 40/46*** | (2020.01) |

(56) References Cited

U.S. PATENT DOCUMENTS

| | | | | |
|---|---|---|---|---|
| 2007/0240729 | A1 | 10/2007 | Moffitt | |
| 2014/0305448 | A1 | 10/2014 | Zuber et al. | |
| 2015/0013696 | A1* | 1/2015 | Plojoux | A61M 15/06 131/328 |
| 2016/0331031 | A1* | 11/2016 | Malgat | A24D 1/20 |
| 2017/0340017 | A1* | 11/2017 | Thorens | A24F 40/40 |
| 2018/0177235 | A1 | 6/2018 | Minzoni | |
| 2019/0075845 | A1 | 3/2019 | Malgat et al. | |
| 2019/0116874 | A1 | 4/2019 | England et al. | |
| 2020/0205467 | A1* | 7/2020 | Liu | A24B 15/167 |

FOREIGN PATENT DOCUMENTS

| | | | | |
|---|---|---|---|---|
| CN | 204707983 | U | 10/2015 | |
| CN | 107536115 | A | 1/2018 | |
| CN | 207306083 | U | 5/2018 | |
| CN | 108113051 | A | 6/2018 | |
| CN | 207604513 | U | 7/2018 | |
| CN | 108366618 | A | 8/2018 | |
| CN | 108601394 | A | 9/2018 | |
| CN | 207912052 | U | 9/2018 | |
| CN | 208258994 | U | 12/2018 | |
| EP | 2 760 303 | B1 | 5/2015 | |
| EP | 3 075 269 | A2 | 10/2016 | |
| EP | 3494809 | A1 * | 6/2019 | A24D 1/20 |
| GB | 2 082 042 | A | 3/1982 | |
| JP | 48-12996 | | 4/1973 | |
| JP | 56-46400 | Y2 | 10/1981 | |
| JP | 59-154977 | A | 9/1984 | |
| JP | 60-137273 | A | 7/1985 | |
| JP | 2015-508676 | A | 3/2015 | |
| JP | 2015-518730 | A | 7/2015 | |
| JP | 6371927 | B1 | 8/2018 | |
| KR | 10-2018-0070515 | A | 6/2018 | |
| KR | 10-2019-0015873 | A | 2/2019 | |
| KR | 10-2019-0016339 | A | 2/2019 | |
| RU | 2 609 395 | C2 | 2/2017 | |
| RU | 2 665 435 | C1 | 8/2018 | |
| WO | WO 2012/164009 | A2 | 12/2012 | |
| WO | WO 2013/076098 | A2 | 5/2013 | |
| WO | WO 2013/098405 | A2 | 7/2013 | |
| WO | WO 2013/098410 | A2 | 7/2013 | |
| WO | WO 2013/182995 | A1 | 12/2013 | |
| WO | WO 2015/007400 | A1 | 1/2015 | |
| WO | WO 2015/007401 | A1 | 1/2015 | |
| WO | WO 2015/082648 | A1 | 6/2015 | |
| WO | WO 2016/207192 | A1 | 12/2016 | |
| WO | WO 2017/040608 | A2 | 3/2017 | |
| WO | WO 2017/114683 | A1 | 7/2017 | |
| WO | WO 2017/198837 | A1 | 11/2017 | |
| WO | WO 2017/198838 | A1 | 11/2017 | |
| WO | WO-2018214953 | A1 * | 11/2018 | A24B 15/167 |
| WO | WO-2018224679 | A1 * | 12/2018 | A24D 1/20 |
| WO | WO 2019/063737 | A1 | 4/2019 | |

OTHER PUBLICATIONS

International Search Report and Written Opinion issued on Aug. 3, 2020 in PCT/EP2020/057660 filed Mar. 19, 2020, 4 pages.

Combined Chinese Office Action and Search Report issued Sep. 20, 2023, in corresponding Chinese Patent Application No. 202080020154.0 (with English Translation), 16 pages.

Combined Russian Office Action and Search Report issued on Jun. 23, 2023 in Russian Patent Application No. 2021128679 (with English translation), 13 pages.

Japanese Notice of Reasons of Refusal mailed on May 13, 2024 issued in Japanese Patent Application No. 2021-555538, with English Translation, total 9 pages.

* cited by examiner

AEROSOL-GENERATING ARTICLE HAVING A TUBULAR SUPPORT ELEMENT

The present invention relates to an aerosol-generating article having a hollow tubular support element positioned immediately downstream of a plug of aerosol-forming substrate and a filter segment positioned immediately downstream of the hollow tubular support element.

Aerosol-generating articles in which an aerosol-forming substrate, such as a tobacco-containing substrate, is heated rather than combusted, are known in the art. Typically in such heated smoking articles, an aerosol is generated by the transfer of heat from a heat source to a physically separate aerosol-forming substrate or material, which may be located in contact with, within, around, or downstream of the heat source. During use of the aerosol-generating article, volatile compounds are released from the aerosol-forming substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-forming substrate of a heated aerosol-generating article.

It is common to include in an aerosol-generating article for producing an inhalable aerosol upon heating one or more additional elements that are assembled with the substrate in a same wrapper. Examples of such additional elements include a mouthpiece filtration segment, a support element adapted to impart structural strength to the aerosol-generating article, a cooling element adapted to favour cooling of the aerosol prior to reaching the mouthpiece, and so forth. However, although such additional elements may have several advantageous effects, their inclusion in an aerosol-generating article generally complicates the overall structure of the article and makes its manufactures more complex and less cost-effective.

It would be desirable to provide an aerosol-generating article that is more simple and cost-effective to manufacture without diminishing the function of the aerosol-generating article.

The present invention relates to an aerosol-generating article. The aerosol-generating article may have an upstream end and a downstream end, the aerosol-generating article defining a longitudinal direction extending between the upstream end and the downstream end. The aerosol-generating article may comprise a plug of aerosol-forming substrate at the upstream end of the aerosol-generating article and a hollow tubular support element positioned immediately downstream of the plug of aerosol-forming substrate. The aerosol-generating article may also comprises a filter segment at the downstream end of the aerosol-generating article and positioned immediately downstream of the hollow tubular support element. The aerosol-generating article may have a length extending in the longitudinal direction between the upstream end and the downstream end. The hollow tubular support element may have a length extending in the longitudinal direction between a first end of the hollow tubular support element and a second end of the hollow tubular support element. The ratio of the length of the hollow tubular support element to the length of the aerosol-generating article may be between about 0.3 to 1 and about 0.5 to 1.

Preferably, the present invention relates to an aerosol-generating article having an upstream end and a downstream end, the aerosol-generating article defining a longitudinal direction extending between the upstream end and the downstream end, the aerosol-generating article comprising: a plug of aerosol-forming substrate at the upstream end of the aerosol-generating article; a hollow tubular support element positioned immediately downstream of the plug of aerosol-forming substrate; and a filter segment at the downstream end of the aerosol-generating article and positioned immediately downstream of the hollow tubular support element; wherein the aerosol-generating article has a length extending in the longitudinal direction between the upstream end and the downstream end; wherein the hollow tubular support element has a length extending in the longitudinal direction between a first end of the hollow tubular support element and a second end of the hollow tubular support element; and wherein the ratio of the length of the hollow tubular support element to the length of the aerosol-generating article is between 0.3 to 1 and 0.5 to 1.

The term "aerosol-generating article" is used herein to describe an article comprising an aerosol-forming substrate that may be heated to produce and deliver an aerosol to a consumer. As used herein, the term "aerosol-forming substrate" denotes a substrate capable of releasing volatile compounds upon heating to generate an aerosol. During use, volatile compounds are released from the aerosol-forming substrate by heat transfer and entrained in air drawn through the aerosol-generating article. As the released compounds cool they condense to form an aerosol that is inhaled by the consumer.

As used herein, the term "hollow tubular support element" denotes an elongate element defining a lumen or airflow passage along a longitudinal axis thereof. In the context of the present specification, the term "tubular" is intended to encompass any tubular element having a substantially cylindrical cross-section which defines at least one airflow passage establishing fluid communication between an upstream end of the tubular element and a downstream end of the tubular element.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The terms "transverse" and "radial" refer to the direction that is perpendicular to the longitudinal axis. Any reference to the "cross-section" of the aerosol-generating article or a component of the aerosol-generating article refers to the transverse cross-section unless stated otherwise.

Advantageously, aerosol-generating articles according to the present invention comprise a hollow tubular support element positioned immediately downstream of a plug of aerosol-forming substrate and a filter segment positioned immediately downstream of the hollow tubular support element. In other words, the hollow tubular support element extends between the plug of aerosol-forming substrate and the filter segment. Advantageously, this simplifies the construction of the aerosol-generating article when compared to known articles in which a plurality of elements are positioned between an aerosol-forming substrate and a filter segment. Advantageously, a simplified construction facilitates a simple and cost effective manufacturing process.

Advantageously, aerosol-generating articles according to the present invention comprise a hollow tubular support element, wherein a ratio of a length of the hollow tubular support element to a length of the aerosol-generating article is between about 0.3 to 1 and about 0.5 to 1. Advantageously, the length of the hollow tubular support element compared to the length of the aerosol-generating article is larger than known aerosol-generating articles comprising a tubular segment. Advantageously, the longer length of the hollow tubular support element makes it easier to handle the hollow tubular support element during manufacture of the aerosol-generating article. Advantageously, the longer length of the hollow tubular support element may provide the aerosol-generating article with the same amount of aerosol-cooling as known articles having a shorter tubular segment combined with an aerosol-cooling element.

The plug of aerosol-forming substrate may have a length extending in the longitudinal direction between a first end of the plug of aerosol-forming substrate and a second end of the plug of aerosol-forming substrate. The ratio of the length of the plug of aerosol-forming substrate to the length of the hollow tubular support element may be between about 0.5 to 1 and about 0.8 to 1. The ratio of the length of the plug of aerosol-forming substrate to the length of the hollow tubular support element may be between about 0.5 to 1 and about 0.7 to 1. The ratio of the length of the plug of aerosol-forming substrate to the length of the hollow tubular support element may be between about 0.5 to 1 and about 0.6 to 1.

The length of the hollow tubular support element may be less than about 50 millimetres. The length of the hollow tubular support element may be less than about 40 millimetres. The length of the hollow tubular support element may be less than about 30 millimetres. The length of the hollow tubular support element may be greater than about 14 millimetres. The length of the hollow tubular support element may be greater than about 17 millimetres. The length of the hollow tubular support element may be between about 14 millimetres and about 22 millimetres. The length of the hollow tubular support element may be between about 17 millimetres and about 22 millimetres. The length of the hollow tubular support element may be about 21 millimetres.

The length of the plug of aerosol-forming substrate may be between about 11 millimetres and about 19 millimetres. The length of the plug of aerosol-forming substrate may be between about 11 millimetres and about 15 millimetres. The length of the plug of aerosol-forming substrate may be about 12 millimetres.

Advantageously, a plug of aerosol-forming substrate having a length within one or more of these ranges may contain a sufficient amount of volatile compounds to facilitate the simulation of smoking a conventional cigarette.

Advantageously, a plug of aerosol-forming substrate having a length within one or more of these ranges may reduce or minimise the required size of a heater in an aerosol-generating device for heating the article. Advantageously, this may facilitate a cost-effective manufacture of an aerosol-generating device.

The filter segment may have a length extending in the longitudinal direction between a first end of the filter segment and a second end of the filter segment of between about 11 millimetres and about 13 millimetres. Advantageously, a filter segment having a length within this range may provide the aerosol-generating article with a desired resistance to draw. In particular, since the hollow tubular support element may have a relatively low resistance to draw, a filter segment having a length of between about 11 millimetres and about 13 millimetres may have a sufficiently high resistance to draw to provide the aerosol-generating article with a desired overall resistance to draw.

The length of the aerosol-generating article may be between about 40 millimetres and about 100 millimetres. The length of the aerosol-generating article may be between about 40 millimetres and about 80 millimetres. The length of the aerosol-generating article may be between about 40 millimetres and about 50 millimetres. The length of the aerosol-generating article may be about 45 millimetres.

The hollow tubular support element may comprise a polymer. The tubular support element may comprise at least one of polylactic acid, cellulose acetate, starch, poly hydroxy alkanoate, polypropylene, polyethylene, polystyrene, and combinations thereof. Preferably, the tubular support element comprises a bioplastic. Preferably, the hollow tubular support element comprises at least one of polylactic acid, cellulose acetate, starch, poly hydroxy alkanoate, and combinations thereof.

Advantageously, forming the hollow tubular support element from a polymer may facilitate simple and cost-effective manufacture of the hollow tubular support element. For example, the hollow tubular support element may be formed by at least one of 3D-printing and injection moulding.

Advantageously, forming the hollow tubular support element from at least one of polylactic acid and cellulose acetate may provide the hollow tubular support element with sufficient hardness to facilitate handling of the hollow tubular support element during manufacture of the aerosol-generating article.

Advantageously, forming the hollow tubular support element from at least one of polylactic acid and cellulose acetate may provide the hollow tubular support element with a sufficient heat capacity to provide a desired aerosol-cooling function during use of the aerosol-generating article.

Preferably, the hollow tubular support element comprises a peripheral wall defining the tubular shape of the hollow tubular support element. The peripheral wall may have a thickness of between about 0.2 millimetres and about 5 millimetres. The peripheral wall may have a thickness of less than about 2 millimetres. The peripheral wall may have a thickness of less than about 1.5 millimetres. The peripheral wall may have a thickness of less than about 1 millimetre. The peripheral wall may have a thickness of at least about 0.2 millimetres. The peripheral wall may have a thickness of at least about 0.4 millimetres. The peripheral wall may have a thickness of at least about 0.5 millimetres. The peripheral wall may have a thickness of about 0.71 millimetres.

The term "thickness" when referring to the peripheral wall of the hollow tubular support element is used herein to refer the minimum distance measured between an outer surface and an inner surface of the peripheral wall. The distance at a given location is measured along a direction locally substantially perpendicular to the outer and inner surfaces of the peripheral wall. For a substantially cylindrical hollow tubular support element, that is, a hollow tubular support element having a substantially circular cross-section, the thickness of the peripheral wall is the distance between the outer surface and the inner surface of the peripheral wall measured along a substantially radial direction of the tubular element.

The hollow tubular support element may have an external diameter of between about 5 millimetres and about 12 millimetres. The hollow tubular support element may have an external diameter of between about 5 millimetres and about 10 millimetres. The hollow tubular support element may have an external diameter of between about 6 millimetres and about 8 millimetres. The hollow tubular support element may have an external diameter of between about 6.5 millimetres and about 7.5 millimetres. Advantageously, a hollow tubular support element having a diameter within these ranges may facilitate forming the aerosol-generating article with an external diameter similar to a conventional cigarette. In a preferred embodiment, the hollow tubular support element has an external diameter of 7.1 mm+/−10 percent.

In embodiments in which the hollow tubular support element comprises a peripheral wall, the peripheral wall may define an inner volume. The hollow tubular support element may comprise a radial structure extending radially within the inner volume from at least a first point on the peripheral wall to at least a second point on the peripheral wall so that at least two airflow passages are defined by the peripheral wall and the radial structure, the at least two airflow passages extending in the longitudinal direction.

Advantageously, the radial structure may increase the compressive strength of the hollow tubular support element in the radial direction.

Advantageously, the radial structure may increase the internal surface area of the hollow tubular support element. Advantageously, increasing the internal surface area of the hollow tubular support element may increase the aerosol-cooling function of the hollow tubular support element.

The cross-sectional shape of the radial structure may be cross-shaped so that the peripheral wall and the radial structure define four airflow passages extending in the longitudinal direction.

Preferably, the radial structure is formed integrally with the peripheral wall. In other words, preferably, the radial structure and the peripheral wall are formed as a single piece. For example, the peripheral wall and the radial structure may be formed as a single piece in a 3D-printing or injection moulding process.

The radial structure may extend along substantially the entire length of the hollow tubular support element.

The radial structure may have a substantially constant cross-sectional shape in the longitudinal direction. The radial structure may have a substantially constant cross-sectional area in the longitudinal direction.

The radial structure may have a rotationally symmetric cross-sectional shape. Advantageously, a rotationally symmetric cross-sectional shape may provide the at least two airflow passages with substantially the same cross-sectional areas. Advantageously, this may provide a substantially uniform airflow through the hollow tubular support element.

Preferably, the first end of the hollow tubular support element is positioned immediately downstream of the plug of aerosol-forming substrate and the radial structure is shaped to define a recess at the first end of the hollow tubular support element, the recess extending into the inner volume defined by the peripheral wall.

Providing a recess in the radial structure at the first end of the hollow tubular support element may be particularly advantageous in embodiments in which a heater is inserted into the aerosol-forming substrate to heat the aerosol-forming substrate. For example, the aerosol-generating article may be inserted into an aerosol-generating device comprise an elongate heater that is inserted into the aerosol-forming substrate from the upstream end of the aerosol-generating article. Advantageously, the recess in the radial structure may be arranged to receive a tip of the elongate heater. Advantageously, receiving a tip of the elongate heater in the recess in the radial structure may facilitate insertion of the elongate heater through the entire length of the aerosol-forming substrate in the longitudinal direction. Advantageously, the recess in the radial structure may receive the tip of the elongate heater without the need for direct contact between the elongate heater and the hollow tubular support element. Advantageously, preventing direct contact between the heater and the hollow tubular support element may prevent melting of the hollow tubular support element during heating of the aerosol-forming substrate.

Providing a recess in the radial structure at the first end of the hollow tubular support element may be particularly advantageous in embodiments in which the aerosol-generating article comprises a heating element received within the aerosol-forming substrate. For example, the aerosol-generating article may comprise a susceptor positioned within the aerosol-forming substrate. The susceptor may function as a heating element to heat the aerosol-forming substrate when the susceptor is inductively heated. Advantageously, the recess in the radial structure may receive an end of the heating element. Advantageously, positioning an end of the heating element in the recess in the radial structure may facilitate a heating element that extends through the entire length of the aerosol-forming substrate in the longitudinal direction. Advantageously, the recess in the radial structure may receive the end of the heating element without the need for direct contact between the heating element and the hollow tubular support element. Advantageously, preventing direct contact between the heating element and the hollow tubular support element may prevent melting of the hollow tubular support element during heating of the aerosol-forming substrate.

Preferably, the aerosol-generating article comprises an outer wrapper wrapped around the plug of aerosol-forming substrate, the hollow tubular support element, and the filter segment. Preferably, the wrapper is a paper wrapper.

Preferably, the filter segment is in the form of a plug. Preferably, the filter segment comprise fibres. Preferably, the fibres of the filter segment comprise cellulose acetate.

Preferably, the aerosol-forming substrate comprises plant material and an aerosol former. Preferably, the plant material is a plant material comprising an alkaloid, more preferably a plant material comprising nicotine, and more preferably a tobacco-containing material.

Preferably, the aerosol-forming substrate comprises at least 70 percent of plant material, more preferably at least 90 percent of plant material by weight on a dry weight basis. Preferably, the aerosol-forming substrate comprises less than 95 percent of plant material by weight on a dry weight basis, such as from 90 to 95 percent of plant material by weight on a dry weight basis.

Preferably, the aerosol-forming substrate comprises at least 5 percent of aerosol former, more preferably at least 10 percent of aerosol former by weight on a dry weight basis. Preferably, the aerosol-forming substrate comprises less than 30 percent of aerosol former by weight on a dry weight basis, such as from 5 to 30 percent of aerosol former by weight on a dry weight basis.

In some particularly preferred embodiments, the aerosol-forming substrate comprises plant material and an aerosol former, wherein the substrate has an aerosol former content of between 5 percent and 30 percent by weight on a dry weight basis. The plant material is preferably a plant material comprising an alkaloid, more preferably a plant material comprising nicotine, and more preferably a tobacco-containing material. Alkaloids are a class of naturally occurring nitrogen-containing organic compounds. Alkaloids are found mostly in plants, but are also found in bacteria, fungi and animals. Examples of alkaloids include, but are not limited to, caffeine, nicotine, theobromine, atropine and tubocurarine. A preferred alkaloid is nicotine, which may be found in tobacco.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco. The aerosol-forming substrate may comprise both solid and liquid components. The aerosol-forming substrate may comprise a tobacco-containing material containing volatile tobacco flavour compounds, which are released from the substrate upon heating. The aerosol-forming substrate may comprise a non-tobacco material. The aerosol-forming substrate may further comprise an aerosol former. Examples of suitable aerosol formers are glycerine and propylene glycol.

In some preferred embodiments, the aerosol-forming substrate may comprise a textured sheet of homogenised tobacco material with an aerosol former content of between 5% and 30% by weight on a dry weight basis. Use of a textured sheet of homogenised tobacco material may advantageously facilitate gathering of the sheet of homogenised tobacco material to form the aerosol-forming substrate.

As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

The aerosol-forming substrate of the present invention preferably comprises an aerosol former. As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate is in the form of a rod comprising a gathered sheet of aerosol-forming material, for example a gathered sheet of homogenised tobacco, or a gathered sheet comprising a nicotine salt and an aerosol former.

Aerosol-forming substrates comprising gathered sheets of homogenised tobacco for use in the aerosol-generating article may be made by methods known in the art, for example the methods disclosed in WO 2012/164009 A2.

Preferably, the aerosol-forming substrate has an external diameter of at least 5 millimetres. The aerosol-forming substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the aerosol-forming substrate has an external diameter of 7.2 millimetres+/−10 percent.

The aerosol-forming substrate may have a length of between approximately 5 millimetres and approximately 15 millimetres, for example between about 8 millimetres and about 12 millimetres. In one embodiment, the aerosol-forming substrate may have a length of approximately 10 millimetres. In a preferred embodiment, the aerosol-forming substrate has a length of approximately 12 millimetres. Preferably, the aerosol-forming substrate is substantially cylindrical.

According to a second aspect of the present invention there is provided an aerosol-generating system comprising and aerosol-generating device and an aerosol-generating article according to the first aspect of the present invention in accordance with any of the embodiments described herein. The aerosol-generating device comprises a cavity arranged to receive at least a portion of the aerosol-generating article and a heater positioned to heat the plug of aerosol-forming substrate when the aerosol-generating article is received within the cavity.

As used herein, the term "aerosol generating device" refers to a device comprising a heater that interacts with the aerosol-forming substrate of the aerosol-generating article to generate an aerosol.

The heater may be positioned within the cavity and arranged for insertion into the plug of aerosol-forming substrate when the aerosol-generating article is received within the cavity. The heater may extend into the cavity.

The heater may be arranged to extend around an outer surface of the aerosol-generating article when the aerosol-generating article is received within the cavity.

Preferably, the heater is an electrical heater.

The electrical heater may extend into the cavity. The electrical heater may be an elongate electrical heater. The elongate electrical heater may comprise a distal end arranged to be received within an aerosol-generating article and a proximal end opposite the distal end. The electrical heater may be blade-shaped. The electrical heater may be pin-shaped. The electrical heater may be cone-shaped.

The elongate electrical heater may comprise at least one resistive heating track. The at least one resistive heating track may be surrounded by an electrically insulating substrate. The at least one resistive heating track may be embedded within an electrically insulating substrate. The electrically insulating substrate may comprise a ceramic.

The electrically insulating substrate may be received within a tubular shell. The tubular shell may comprise at least one metal.

The electrical heater may comprise a resistive heating element. During use, an electrical current is supplied to the resistive heating element to generate heat by resistive heating.

Suitable materials for forming the resistive heating element include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

In some embodiments, the resistive heating element comprises one or more stamped portions of electrically resistive material, such as stainless steel. Alternatively, the resistive heating element may comprise a heating wire or filament, for example a Ni—Cr (Nickel-Chromium), platinum, tungsten or alloy wire.

The electrical heater may comprise an electrically insulating substrate, wherein the resistive heating element is provided on the electrically insulating substrate. The electrically insulating substrate may be a ceramic material such as Zirconia or Alumina. Preferably, the electrically insulating substrate has a thermal conductivity of less than or equal to about 2 Watts per metre Kelvin.

The electrical heater may be arranged to extend around an outer surface of an aerosol-generating article received within the cavity. The electrical heater may have a tubular shape. The electrical heater may comprise an electrically insulating substrate and at least one resistive heating track on the electrically insulating substrate. The electrically insulating substrate may comprise a flexible sheet. Advantageously, a flexible sheet may facilitate manufacturing the electrical heater in a flat state and subsequently deforming the flexible sheet into a desired shape. For example, the electrical heater may be formed in a flat state and then rolled into a tubular shape. The electrically insulating substrate may comprise a polyimide film. The at least one resistive heating track may comprise at least one metal. The at least one resistive heating track may comprise a metal. The at least one resistive heating track may comprise a metal alloy. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

The at least one resistive heating track may define a plurality of heating zones.

The at least one resistive heating track may comprise a plurality of heating tracks. The plurality of heating tracks may define a plurality of heating zones.

The at least one resistive heating track may comprise a single heating track comprising a plurality of portions, wherein each portion defines a heating zone.

Advantageously, at least some of the heating zones may be heated to different temperature during use. Advantageously, at least some of the heating zones may be heated at different times during use. Each heating zone may be defined by a single resistive heating track. Each heating zone may be defined by a plurality of resistive heating tracks.

The electrical heater may comprise an inductive heating element. During use, the inductive heating element inductively heats a susceptor material to heat the aerosol-generating article when the aerosol-generating article is received within the cavity. The susceptor material may form part of the aerosol-generating device. The susceptor material may form part of the aerosol-generating article.

Preferably, the aerosol-generating device comprises a power supply and a controller arranged to supply power from the power supply to the electrical heater during use of the aerosol-generating device.

Preferably, the controller is arranged to supply power from the power supply to the electrical heater according to a predetermined heating cycle when the aerosol-generating device is used to heat the aerosol-generating article received within the cavity.

The power supply may be a DC voltage source. In preferred embodiments, the power supply is a battery. For example, the power supply may be a nickel-metal hydride battery, a nickel cadmium battery, or a lithium based battery, for example a lithium-cobalt, a lithium-iron-phosphate or a lithium-polymer battery. The power supply may alternatively be another form of charge storage device such as a capacitor. The power supply may require recharging and may have a capacity that allows for the storage of enough energy for use of the aerosol-generating device with one or more aerosol-generating articles.

Preferably, the aerosol-generating device comprises at least one air inlet. Preferably, the at least one air inlet is in fluid communication with an upstream end of the cavity. In embodiments in which the aerosol-generating device comprises an elongate electrical heater, preferably the elongate electrical heater extends into the cavity from the upstream end of the cavity.

The aerosol-generating device may comprise a sensor to detect air flow indicative of a user taking a puff. The air flow sensor may be an electro-mechanical device. The air flow sensor may be any of: a mechanical device, an optical device, an opto-mechanical device and a micro electro-mechanical systems (MEMS) based sensor. The aerosol-generating device may comprise a manually operable switch for a user to initiate a puff.

The aerosol-generating device may comprise a temperature sensor. The temperature sensor may be mounted on the printed circuit board. In embodiments in which the aerosol-generating device comprises an electrical heater, the temperature sensor may be mounted on the electrical heater. In embodiments in which the electrical heater comprises an electrically insulating substrate, the temperature sensor may be mounted on the electrically insulating substrate. In embodiments in which the electrical heater is an elongate electrical heater, the temperature sensor may be mounted on the distal end of the elongate electrical heater.

The temperature sensor may detect the temperature of the electrical heater or the temperature of the aerosol-generating article received within the cavity. The temperature sensor may be a thermistor. The temperature sensor may be a thermocouple. The temperature sensor may comprise a circuit configured to measure the resistivity of the electrical heater and derive a temperature of the electrical heater by comparing the measured resistivity to a calibrated curve of resistivity against temperature.

Advantageously, deriving the temperature of the electrical heater may facilitate control of the temperature to which the electrical heater is heated during use. The controller may be configured to adjust the supply of power to the electrical heater in response to a change in the measured resistivity of the electrical heater.

Advantageously, deriving the temperature of the electrical heater may facilitate puff detection. For example, a measured drop in the temperature of the electrical heater may correspond to a user puffing or drawing on the aerosol-generating article.

It will be appreciated that any features described with reference to one aspect of the present invention are equally applicable to any other aspect of the invention.

The invention will now be further described, by way of example only, with reference to the accompanying drawings in which.

Figure 1:
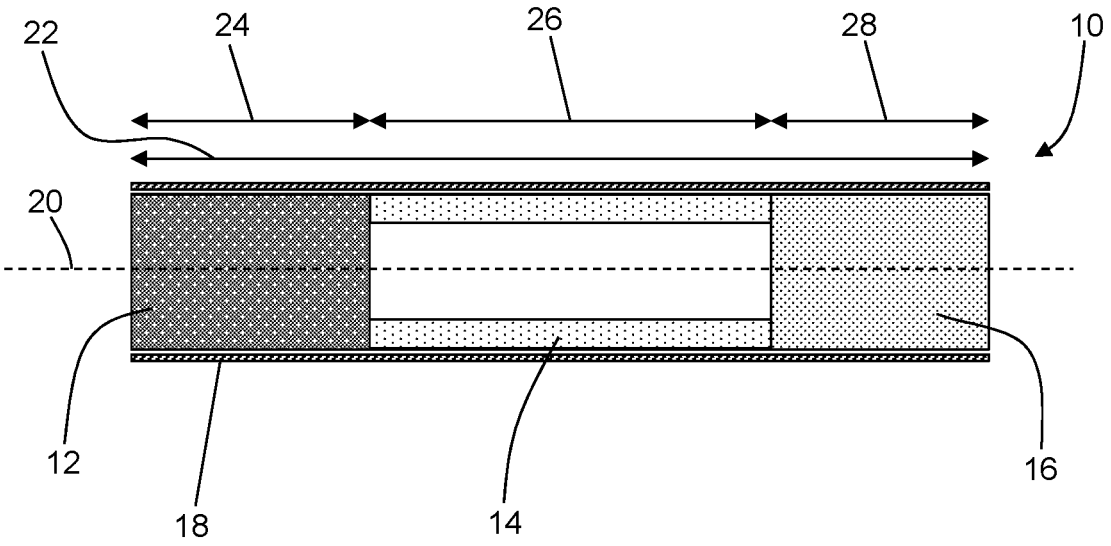
FIG. 1 shows a longitudinal cross-sectional view of an aerosol-generating article in accordance with an embodiment of the present invention.

FIG. 1 shows an aerosol-generating article 10 according to an embodiment of the present invention. The aerosol-generating article 10 comprises a plug of aerosol-forming substrate 12 comprising tobacco and positioned at an upstream end of the aerosol-generating article 10. Positioned immediately downstream of the plug of aerosol-forming substrate 12 is a hollow tubular support element 14 formed of polylactic acid. Positioned immediately downstream of the hollow tubular support element 14 and at a downstream end of the aerosol-generating article 10 is a filter segment 16 comprising fibres of cellulose acetate. The aerosol-generating article 10 also comprises an outer wrapper 18 formed of paper and circumscribing the plug of aerosol-forming substrate 12, the hollow tubular support element 14 and the filter segment 16.

The aerosol-generating article 10 defines a longitudinal direction 20 and has a length 22 extending between the upstream and downstream ends of the aerosol-generating article 10. The length 22 of the aerosol-generating article 10 is 45 millimetres.

The plug of aerosol-forming substrate 12, the hollow tubular support element 14 and the filter segment 16 each have a length 24, 26, 28 respectively. The length 24 of the plug of aerosol-forming substrate 12 is 12 millimetres. The length 26 of the hollow tubular support element 14 is 21 millimetres. The length 28 of the filter segment 18 is 12 millimetres. The ratio of the length 26 of the hollow tubular support element 14 to the length 22 of the aerosol-generating article 10 is 0.47 to 1.

Figure 2:
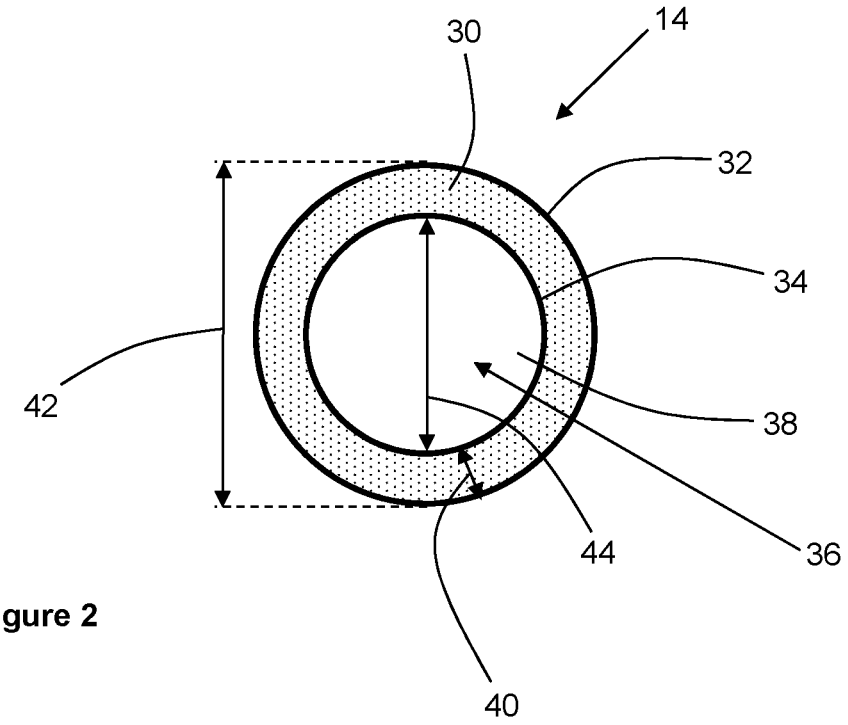
FIG. 2 shows a transverse cross-sectional view of the hollow tubular support element of the aerosol-generating article of FIG. 1.

FIG. 2 shows a lateral cross-sectional view of the hollow tubular support element 14. The hollow tubular support element 14 comprises a peripheral wall 30 defining the tubular shape of the hollow tubular support element 14. The peripheral wall 30 has an external surface 32 and an interior surface 34. The interior surface 34 defines an inner volume 36 that forms an airflow passage 38 extending along the length 26 of the hollow tubular support element 14. The peripheral wall 30 has a thickness 40 of 0.71 millimetres. The hollow tubular support element 14 has a circular annular cross-sectional shape. The hollow tubular support element 14 has an external diameter 42 of 7.1 millimetres and an internal diameter 44 of 5.68 millimetres.

Figure 3:
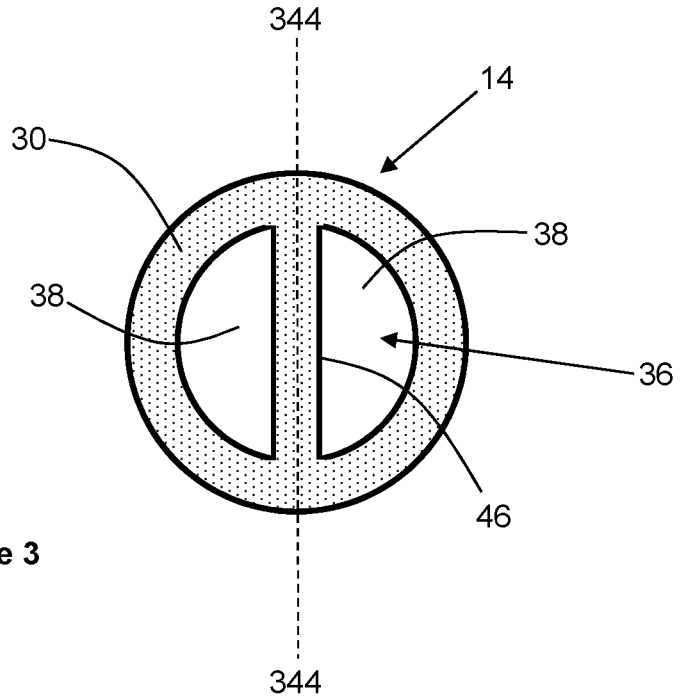
FIG. 3 shows a transverse cross-sectional view of an alternative arrangement of the hollow tubular support element of the aerosol-generating article of FIG. 1.

FIG. 3 shows a lateral cross-sectional view of an alternative arrangement of the hollow tubular support element 14. In the arrangement shown in FIG. 3, the hollow tubular support element 14 comprises a radial structure 46 comprising a single wall extending across the interior volume 36 defined by the peripheral wall 30. The radial structure 46 divides the interior volume 36 into two airflow passages 38. The radial structure 46 is formed integrally with the peripheral wall 30.

Figure 4:
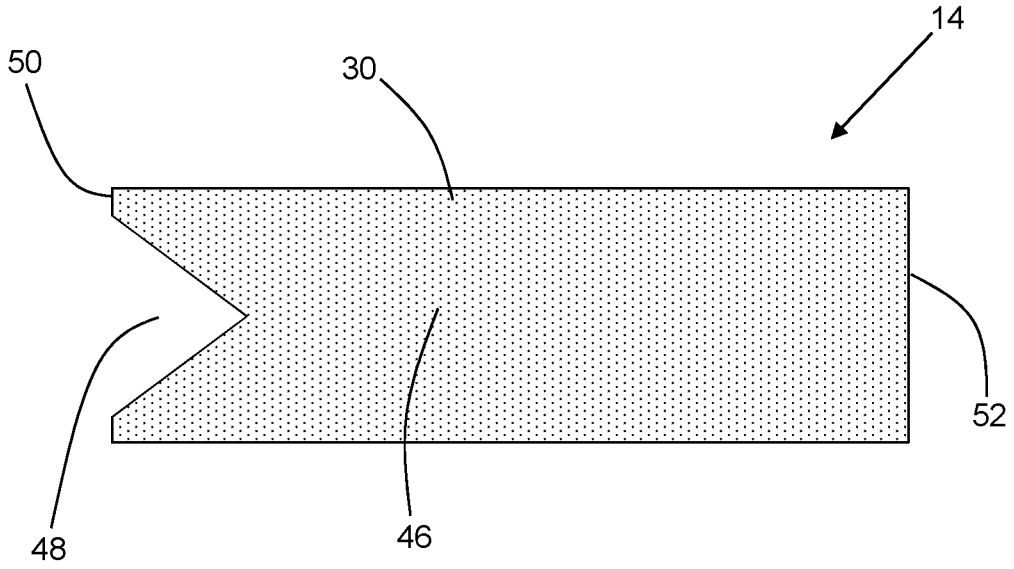
FIG. 4 shows a longitudinal cross-sectional view of the hollow tubular support element of FIG. 3.

FIG. 4 shows a longitudinal cross-sectional view of the hollow tubular support element 14 of FIG. 3, taken along the line 344-344 shown in FIG. 3. The hollow tubular support element 14 comprises a recess 48 formed in the radial structure 46 at a first end 50 of the hollow tubular support element 14. When the hollow tubular support element 14 is assembled with the plug of aerosol-forming substrate 12 and the filter segment 16 to form the aerosol-generating article 10, the first end 50 comprising the recess 48 is positioned adjacent to the plug of aerosol-forming substrate 12. In other words, the recess 48 is positioned at an upstream end of the hollow tubular support element 14. A second end 52 of the hollow tubular support element 14 forms a downstream end of the hollow tubular support element 14. During use of the aerosol-generating article 10 in an aerosol-generating device, the recess 48 may receive a tip of a heater inserted through the plug of aerosol-forming substrate 12.

Figure 5:
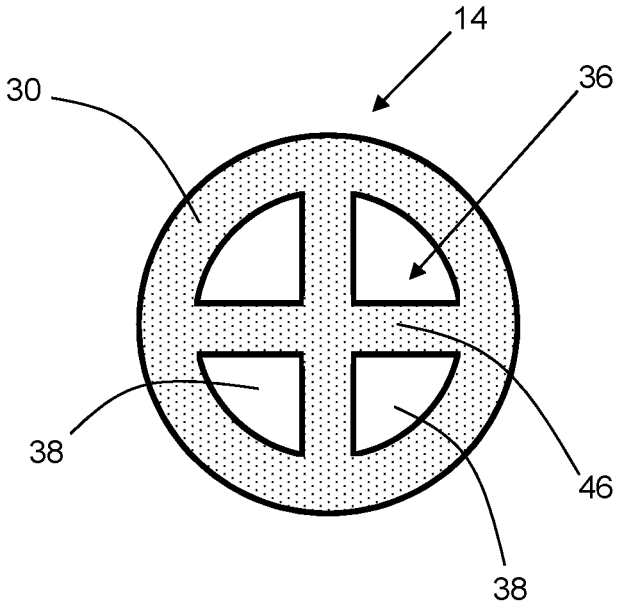
FIG. 5 shows a transverse cross-sectional view of a further alternative arrangement of the hollow tubular support element of the aerosol-generating article of FIG. 1.

FIG. 5 shows a lateral cross-sectional view of a further alternative arrangement of the hollow tubular support element 14, similar to the arrangement shown in FIG. 3. In the arrangement shown in FIG. 5, the radial structure 46 is cross-shaped and divides the interior volume 36 into four airflow passages 38. The hollow tubular support element 14 may comprise a recess 48 in the radial structure 46, as already described with reference to FIG. 4.

Figure 6:
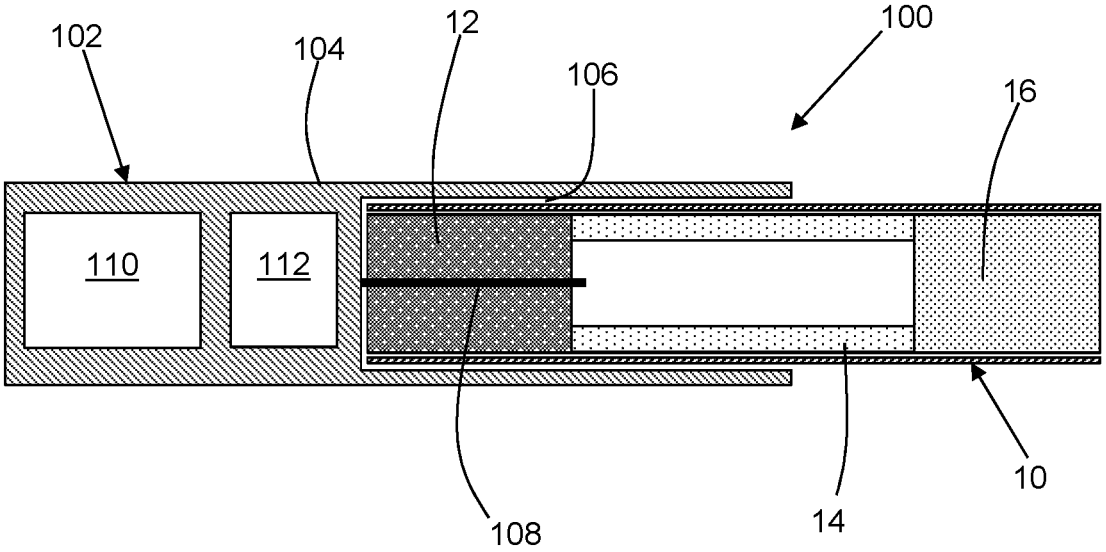
FIG. 6 shows a longitudinal cross-sectional view of an aerosol-generating system comprising the aerosol-generating article of FIG. 1.

FIG. 6 shows a longitudinal cross-sectional view of an aerosol-generating system 100 comprising an aerosol-generating device 102 and the aerosol-generating article 10 of FIG. 1. The aerosol-generating device 102 comprises a housing 104 defining a cavity 106 for receiving the aerosol-generating article 10. An elongate electrical heater 108 extends into the cavity 106 and is arranged for insertion into the plug of aerosol-forming substrate 12 when the aerosol-generating article 10 is inserted into the cavity 106. The aerosol-generating device 102 also comprises a power supply 110 and a controller 112. During use, the controller 112 controls a supply of electrical power from the power supply 110 to the elongate electrical heater 108. The elongate electrical heater 108 heats the plug of aerosol-forming substrate 12 to release volatile compounds from the plug of aerosol-forming substrate 12. When a user draws on the filter segment 16, the released compounds are drawn into the hollow tubular support element 14 where they cool to form an aerosol. The aerosol is then drawn through the filter segment 16 where they are delivered to the user.

The invention claimed is:

1. An aerosol-generating article having an upstream end and a downstream end, the aerosol-generating article defining a longitudinal direction extending between the upstream end and the downstream end, the aerosol-generating article comprising:

a plug of aerosol-forming substrate at the upstream end of the aerosol-generating article, the aerosol-forming substrate comprising an aerosol former;

a hollow tubular support element positioned immediately downstream of the plug of aerosol-forming substrate; and a filter segment at the downstream end of the aerosol-generating article and positioned immediately downstream of the hollow tubular support element, wherein the aerosol-generating article has a length extending in the longitudinal direction between the upstream end and the downstream end, wherein the plug of aerosol-forming substrate has a length extending in the longitudinal direction between a first end of the plug of aerosol-forming substrate and a second end of the plug of aerosol-forming substrate, wherein the hollow tubular support element has a length extending in the longitudinal direction between a first end of the hollow tubular support element and a second end of the hollow tubular support element, wherein a ratio of the length of the hollow tubular support element to the length of the aerosol-generating article is between 0.3 to 1 and 0.5 to 1, wherein a ratio of the length of the plug of aerosol-forming substrate to the length of the hollow tubular support element is between 0.5 to 1 and 0.8 to 1, wherein the hollow tubular support element comprises:

a peripheral wall defining a tubular shape of the hollow tubular support element, the peripheral wall defining an inner volume, and a radial structure extending radially within the inner volume from at least a first point on the peripheral wall to at least a second point on the peripheral wall so that at least two airflow passages are defined by the peripheral wall and the radial structure, the at least two airflow passages extending in the longitudinal direction, and the radial structure comprising a wall portion intersecting a longitudinal axis of the hollow tubular support element, wherein the first end of the hollow tubular support element is positioned immediately downstream of the plug of aerosol-forming substrate, and wherein the radial structure is shaped to define a recess at the first end of the hollow tubular support element, the recess extending into the inner volume defined by the peripheral wall.

2. The aerosol-generating article according to claim 1, wherein the length of the hollow tubular support element is between 14 millimeters and 22 millimeters.

3. The aerosol-generating article according to claim 1, wherein the length of the plug of aerosol-forming substrate is between 11 millimeters and 19 millimeters.

4. The aerosol-generating article according to claim 1, wherein the filter segment has a length extending in the longitudinal direction between a first end of the filter segment and a second end of the filter segment of between 11 millimeters and 13 millimeters.

5. The aerosol-generating article according to claim 1, wherein the length of the aerosol-generating article is between 40 millimeters and 50 millimeters.

6. The aerosol-generating article according to claim 1, wherein the hollow tubular support element comprises a polymer.

7. The aerosol-generating article according to claim 6, wherein the polymer is at least one of polylactic acid, cellulose acetate, starch, and poly hydroxy alkanoate.

8. The aerosol-generating article according to claim 1, wherein the hollow tubular support element has an external diameter of between 6 millimeters and 8 millimeters.

9. The aerosol-generating article according to claim 1, wherein the peripheral wall has a thickness of between 0.5 millimeter and 1 millimeter.

10. The aerosol-generating article according to claim 1, wherein a cross-sectional shape of the radial structure is cross-shaped so that the peripheral wall and the radial structure define four airflow passages extending in the longitudinal direction.

11. The aerosol-generating article according to claim 1, further comprising an outer wrapper wrapped around the plug of aerosol-forming substrate, the hollow tubular support element, and the filter segment.

12. An aerosol-generating system, comprising:

an aerosol-generating article according to claim 1; and an aerosol-generating device comprising a cavity configured to receive at least a portion of the aerosol-generating article and a heater positioned to heat the plug of aerosol-forming substrate when the aerosol-generating article is received within the cavity.

13. The aerosol-generating system according to claim 12, wherein the heater is positioned within the cavity and configured for insertion into the plug of aerosol-forming substrate when the aerosol-generating article is received within the cavity.

14. The aerosol-generating article according to claim 1, wherein the aerosol former comprises at least one of: a polyhydric alcohol, an ester of a polyhydric alcohol, and an aliphatic ester of a mono-, di-, or polycarboxylic acid.

15. The aerosol-generating article according to claim 14, wherein the polyhydric alcohol is propylene glycol or triethylene glycol or 1,3-butanediol or glycerine.

16. The aerosol-generating article according to claim 14, wherein the ester of the polyhydric alcohol is glycerol mono-, di-, or triacetate.

17. The aerosol-generating article according to claim 14, wherein the aliphatic ester of a mono-, di-, or polycarboxylic acid is dimethyl dodecanedioate and/or dimethyl tetradecanedioate.

18. The aerosol-generating article according to claim 1, wherein the aerosol former comprises at least one of propylene glycol, triethylene glycol, 1,3-butanediol, and glycerine.

* * * * *